US005791505A

United States Patent [19]

Gilliland

[11] Patent Number: 5,791,505

[45] Date of Patent: Aug. 11, 1998

[54] CAP-CARRIED EXTERNAL EXTRACTOR FOR WADDING FILLER IN MEDICINE BOTTLES

[75] Inventor: David E. Gilliland, Clearwater, Fla.

[73] Assignees: Dennis Bloom; Gricel Bloom, both of East Stroudsburg, Pa.; a part interest to each

[21] Appl. No.: 783,850

[22] Filed: Jan. 16, 1997

[51] Int. Cl.[6] ..... B65D 43/00

[52] U.S. Cl. ..... 215/228; 220/212; 220/335; 220/288; 220/761

[58] Field of Search ..... 215/231, 228, 215/295, 303, 399, 395, 302, 304, 305; 220/334, 212, 212.5, 335, 288, 751, 752, 756, 761, 284, 285, 277, 278; 206/528, 540

[56] References Cited

U.S. PATENT DOCUMENTS

| | | | |
|---|---|---|---|
| 775,651 | 11/1904 | Heath | 215/305 |
| 1,475,908 | 11/1923 | Walsh | 215/302 X |
| 1,703,759 | 2/1929 | Ament | 215/228 |
| 2,362,523 | 11/1944 | Armstrong, Jr. et al. | 215/399 |
| 2,447,146 | 8/1948 | Vogel | 215/304 |
| 2,857,068 | 10/1958 | Kraepelin | 215/231 |
| 3,484,013 | 12/1969 | Speicher | 215/399 |
| 3,495,797 | 2/1970 | Ganz | 215/399 X |
| 3,625,386 | 12/1971 | Schaefer | 215/302 X |
| 4,460,143 | 7/1984 | Ohama | 215/399 X |
| 4,883,175 | 11/1989 | Thiele et al. | 215/399 X |
| 5,251,774 | 10/1993 | Engle | 215/228 X |
| 5,427,343 | 6/1995 | Ferris | 215/399 X |

*Primary Examiner*—Allan N. Shoap
*Assistant Examiner*—Robin A. Hylton
*Attorney, Agent, or Firm*—Low and Low

[57] ABSTRACT

A cap for pill bottles and like medicinal containers normally having cotton wadding therein between the pills or capsules and the open mouth of the bottle, wherein the cap is provided with an external hook member which is positionable to be inserted into the bottle to easily remove the cotton without flexing or forcing the fingers into the small mouth bottle.

12 Claims, 3 Drawing Sheets

CAP-CARRIED EXTERNAL EXTRACTOR FOR WADDING FILLER IN MEDICINE BOTTLES

BACKGROUND OF THE INVENTION

In the packaging of medicinal capsules, pills, tablets, ampoules and the like, it is customary to place the medicinal items in a cylindrical container of plastic or the like. As the quantity of pills etc. is less than the capacity of the container or pill bottle, it is also customary to provide a suitable soft wadding as a filler on top of the pills to occupy the space between the top of the pill charge and the top of the container to prevent rattling of the pills in the container, or the chance of possible fracture thereof by relatively free back and forth movement of the pills in the partially filled container during shipment or in other ordinary handling.

Such wadding is customarily and conveniently a small mass of cotton, which is easily handled for insertion into the bottle, is inexpensive, as well as being easily rendered sterile for medical packaging purposes, whether at a pharmaceutical facility or by an individual pharmacist at a drugstore.

In any event, after placement of the cotton filler in the bottle or like container, the same is sealed in various ways conventional in the art. The same typically, for example, may be a seal of foil or foil laminate across the mouth of the container bonded to the container rim or a similar sealing disk inserted within and carried by a closure cap releasably secured to the container. The closure cap is cooperatively associate with the container in various usual ways, as by screw threads, interrupted lugs, snap fit rib and groove means, or various childproof or tamperproof arrangements to deter ready opening of the pill bottle or to indicate the opening thereof, as is well known in the art.

Upon opening of the bottle by removal of the cap, if the seal disk is carried by the cap, the cotton filler is then exposed. In the case of a container having a rim seal across the bottle mouth, the seal must be ruptured or removed to then expose the cotton filler.

Having opened the bottle, the cotton must be removed to gain access to a contained pill or tablet. Pill containers are frequently of relatively narrow diameter, whereby it is often difficult or time-consuming to manage to grip a bit of the cotton in an effort to pull the wad from the bottle. Indeed, a small portion of the cotton may tear free in the user's fingers, whereby the grasping effort must be again made.

Further, frequently the pill user may have restricted prehensile ability in the fingers by virtue of arthritis, injury, deformity, or the like which renders it exceedingly difficult to seize satisfactorily a portion of the cotton to remove the same, with resultant discomfort and discomfiture.

In such cases, the pill user may resort to the use of knives, forks, pencils, etc. in an effort to free the pills from the confining cotton wadding. This itself is not only frustrating, but also time-consuming, and even hazardous in the manipulation of relatively sharp implements.

The problem of cotton extraction has been generally recognized, but previous means have not found wide use due to complexity, cost, and fabrication difficulties. Thus, the Wylie U.S. Pat. No. 2,088,678 provides a built-in wire loop on the cotton itself to ease removal, while McNeil U.S. Pat. No. 2,091,212, Krapelin U.S. Pat. No. 2,857,068 or Thomas U.S. Pat. No. 4,782,967 preattaches the cotton to the cap so that r emoval of the cap pulls upon and removes the cotton.

It is therefore highly desirable to provide an improved effective and inexpensive means to facilitate extraction of the cotton from the pill bottle.

SUMMARY OF THE INVENTION

The present invention embraces the provision of an integral built-in hook member on the exterior of the bottle closure cap. The hook member is pivoted to the cap, and in normal portion lies flush with the top of the cap. In use, the hook is swung upwardly to a projecting position for use, as through 90° to a position substantially perpendicular to the cap top surface.

For ease of engaging the hook to swing it upwardly, the tip thereof extends past the cap for readily engagement by the finger to lift the hook. In a modification, the hook when not in use normally lies within the usual perimeter of the cap, wherein a recess in the cap permits nudging the hook upwardly.

The hook is provided with friction means to hold the same in a projecting position, so that the user may easily hold the cap by its skirt or periphery and advance the hook toward the bottle. The hook is engaged with the cotton and turned slightly as necessary to effect a thorough engagement, and the cotton is then readily removed for access to the pills.

If the pill container is provided with a top closure seal or membrane across the open bottle mouth, the hook may be used to initially rupture the seal to tear away the same as needed to gain access to the cotton.

By the invention herein, the cotton engaging means is provided with the bottle cap itself as part of usual cap molding processes, and no extraneous of foreign elements are needed to effect attachments between the cap and the cotton.

BRIEF DESRCIPTION OF THE DRAWINGS

The invention will be better understood in connection with the accompanying drawings, in which.

DESCRIPTION OF THE PREFERRED EMBODIMENT

Figure 1:
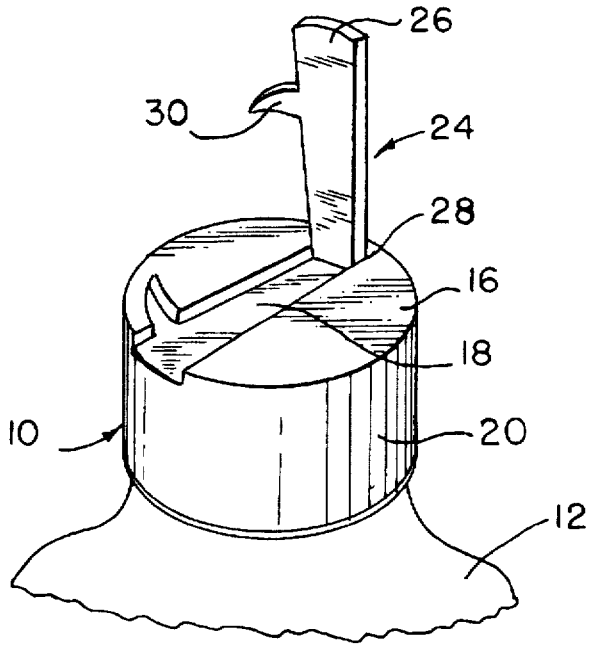
FIG. 1 is a perspective view of the cap of the invention with the hook in use position, the container being shown fragmentarily.
Figure 2:
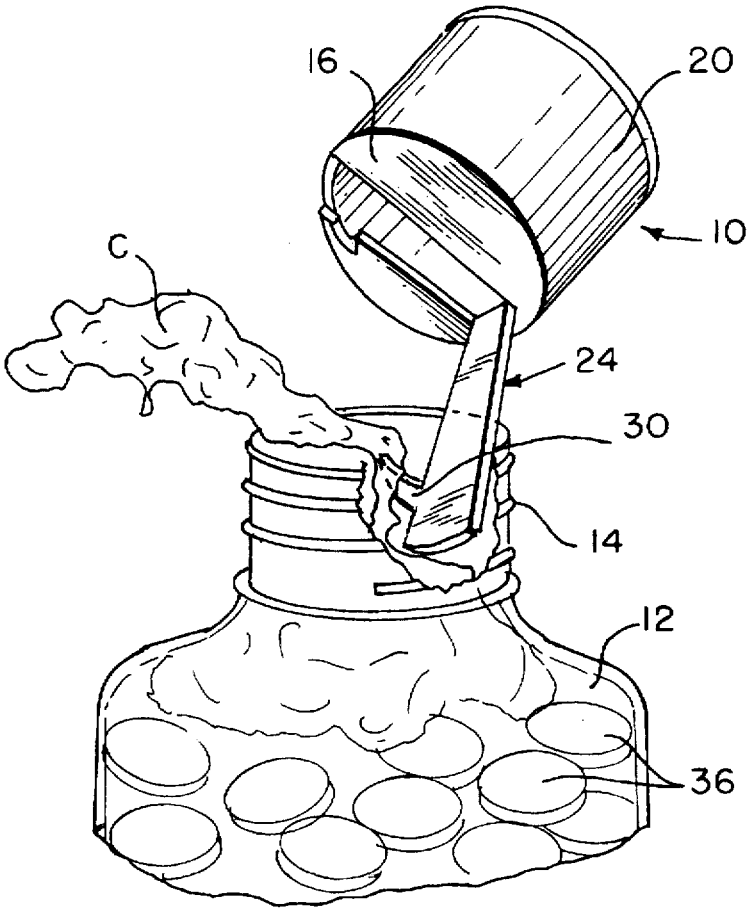
FIG. 2 is a perspective view of the cap with the hook in use to remove the cotton in the bottle above the medication, the bottle being shown fragmentation.

Referring to FIG. 1, the cap 10 of the invention is shown surmounted in usual manner on a pill bottle or like container 12. The cap 10 is detachably secured to the bottle 12 in any well known manner, as by threads 14 on the bottle as seen in FIG. 2 cooperating with complementary threads 22 on the cap skirt 20. The cap is preferably molded from polymeric material as is well known, such as polyethylene or polypropylene.

A rupturable seal, as a foil membrane or foil laminate is interposed between the underside of the cap top surface 16 and the open mouth of the bottle 12. Such seals are conventional, and in the illustrative form of FIGS. 1 and 2, the seal is in the form of a disk 18 which is attached to the inside of the cap be friction or other bonding means, and is thereby removed when the cap is removed. In the form shown in FIG. 6, the seal disk 18 is bonded by adhesive or the like at its periphery to the open mouth of the bottle 12, whereby when the cap is removed, the rupturable seal 18 remains affixed to the bottle.

The cap includes a top substantially planar surface 16 above skirt 20. The top surface 16 is formed by molding or cutting operations to define a hook member 24. The hook member in the preferred form includes a tip portion 26 at its forward free end extending radially outwardly past the skirt 20, the hook member then extending across a major portion of the cap top surface 16, and is integrally connected to the remainder of the cap at an uncut hinge 28. The formation of such integral hinges, per se, is well known in the art.

One elongate side of the hook member 24 is configured to provide a laterally extending pointed hook 30. It is preferred that the hook 30 have an arcuate curve to facilitate engagement with the cotton as well as to pierce the bottle seal 18 if one is present.

The hook member 24 has a snug fit within the cap top surface 16, and when lifted up to the FIG. 1 position the residual friction at the hinge maintains the hook member in upstanding relation. Means may be provided to enhance the relatively fixed upward position as seen illustratively in FIG. 7 wherein the cap top surface 16 is provided with a pair of integrally molded upstanding ears 32, 32 adjacent hinge 26, the confronting faces of which may incline very slightly toward each other so as to provide a slight gripping force on the edges of the hook member when pivoted to its upstanding position.

Such facilitates manipulatio n of the cap in removing the cotton as seen in FIG. 2, when the cap is bodily grasped and the hook member 24 angled downwardly into the cotton 34. Shifting or twisting movement causes the hook 30 to entangle with cotton C permitting the cotton to be pulled out of the bottle 12 with no difficulty thereby to gain access to the pills or other medicament 36.

Figure 8:
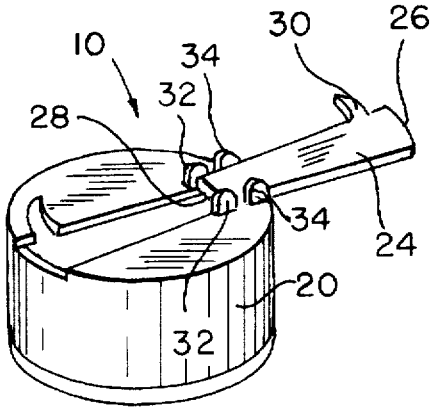

As above indicated, if desired, the hook member 24 may be flipped upwardly from the cap through substantially 180° to the FIG. 8 position is desired, and the cap manipulated in that position to extract the cotton.

Figure 3:
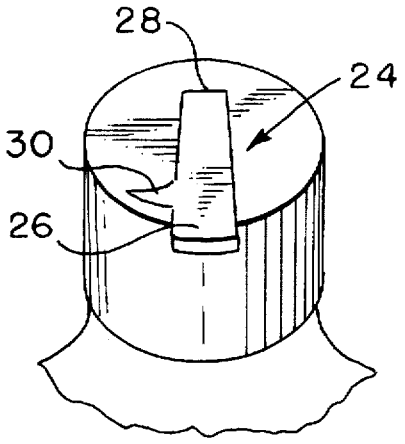
FIG. 3 is a perspective view of the cap of the invention with the hook in folded non-use position, the container being shown fragmentarily.
Figure 4:
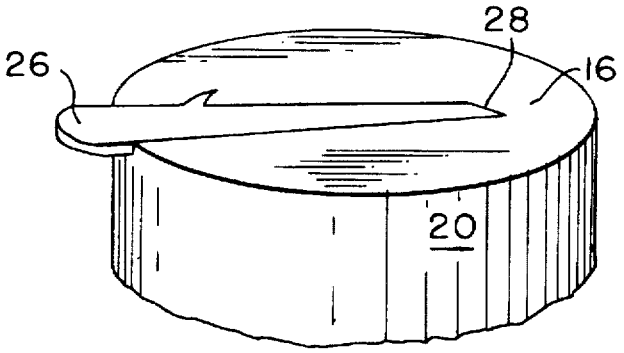
FIG. 4 is a perspective fragmentary view at a lower angle of the cap of the invention with the hook in folded non-use position, illustrating the projection of the hook end outwardly of the cap perimeter.
Figure 5:
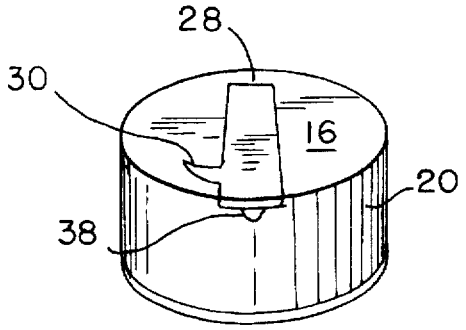
FIG. 5 is a perspective view of a modification of the cap of the invention with hook lying within the cap perimeter.
Figure 6:
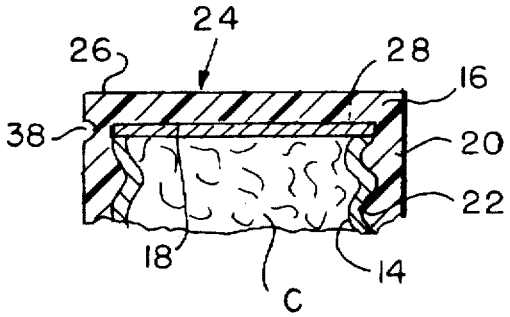
FIG. 6 is a fragmentary sectional view of the modified cap of FIG. 5 upon the bottle showing a seal disk at the top of the bottle.
Figure 7:
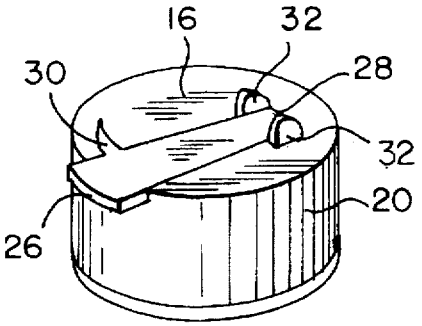
FIG. 7 is a perspective view of the cap of FIG. 1 further showing friction means for maintaining the hook in upstanding position; and, FIG. 8 is a perspective view of the cap of FIG. 1 further showing friction means for maintaining the hook in a rearwardly projecting position.

While in FIGS. 3, 4, and 7 the tip portion 26 of hook member 24 as noted extends slightly beyond the perimeter of the cap, the cap may be so configured and molded whereby the hook member 24 lies within the periphery of the top surface 16 as seen in FIGS. 5 and 6. In this form of the invention, the hook member 24 is less likely to be accidentally flipped open, although the same is slightly more difficult to engage to lift it upwardly.

To facilitate o pening the hook member in the cap of FIG. 5, the cap skirt 20 is provided with an undercut or recess 38 just below the hook member, whereby the finger or fingernail may be positioned beneath the hook tip portion 26 to readily lift it up.

Accordingly, when desired to open the pill bottle or other container, in the preferred embodiment of FIGS. 1–4, while cap is still attached to the bottle, the hook member is engaged at its free end 26 and lifted upwardly to dispose the hook member 24 in exposed relation in the upstanding FIG. 1 position, or if desired in the FIG. 8 position, and retained in either position by friction means, whereupon the hook 30 may engage and remove the cotton C. If the container has a seal membrane 18 as seen in FIG. 6 normally sealing the mouth of the bottle, the same is easily first broken or ruptured with hook 30 before the cotton C is extracted.

It will be se en that no crowding of the fingertips into the small bottle mouth is necessary or any uncomfortable flexing or manipulation of the fingers is required as compared to the simple act of grasping the cap 10 with the external hook member 24 projecting therefrom.

Further, if it is desired to reinsert the cotton filler back into the pill container after use, the hook member 24 also facilitates the same by easily pushing the cotton back down into the bottle.

While I have shown and described the preferred embodiment of may invention and certain modifications thereof, it is evident that the structure may take varying and different forms while still embracing the inventive concept thereof within the claims herein.

What I claim is:

1. A cap for a container having wadding therein beneath the cap, comprising, a top surface and a peripheral skirt on said cap, a hook member on said top surface disposed entirely externally of said cap, said hook member having an elongated portion having opposite ends and extending substantially diametrically of said cap top surface, and including a free tip portion at one of said ends, and a hook point extending laterally from said elongated portion, and, a flexible connection between said hook member and said cap top surface to permit said hook member to be moved to a position to facilitate its entry into the container for the purpose of engaging and removing the wadding, wherein said flexible connection is a hinge disposed at the other said end of said hook member elongated portion.

2. The cap for a container of claim 1 wherein said hook member lies substantially flush with the top surface of the cap when not in use.

3. The cap for a container of claim 1 wherein said hinge is integrally formed with the said cap.

4. The cap for a container of claim 1 wherein said hook member tip portion extends radially outwardly beyond the perimeter of the cap to facilitate lifting the same for use.

5. The cap for a container of claim 1 wherein said hook member tip portion lies within the perimeter of the cap, and wherein said cap skirt is provided with a recess immediately beneath said tip portion to facilitate lifting the same for use.

6. The cap for a container of claim 1 wherein said cap top surface includes friction elements to assist the said hook member to maintain an upwardly extending position when hinged upwardly for use.

7. The cap for a container of claim 1 wherein said cap top surface includes friction elements to assist the said hook member to maintain a laterally extending position when said hook member is hinged through substantially 180° for use.

8. The cap for a container of claim 1 wherein said cap member top surface has a recess therein and said hook member lies recessed within said cap top surface when not in use.

9. The cap for a container of claim 1 wherein said cap top surface includes a plurality of friction elements to assist the said hook member to maintain a first upwardly extending position with respect to the cap top surface when hinged upwardly for use and a second laterally extending position radially outwardly of the cap when said hook member is hinged through substantially 180° for use.

10. The cap for a container of claim 1 wherein said cap skirt has interengaging means to facilitate attaching the cap to a container.

11. The cap for a container of claim 1 wherein said hook point is arcuately curved in a direction toward said cap when said hook member is extended for use to facilitate engagement with and removal of the wadding.

12. The cap for a container of claim 1 wherein said hook point is arcuately curved in a direction toward said cap when said hook member is extended for use to facilitate engagement with and removal of the wadding.

* * * * *

UNITED STATES PATENT AND TRADEMARK OFFICE

CERTIFICATE OF CORRECTION

PATENT NO. : 5,791,505

DATED : August 11, 1998

INVENTOR(S) : David E. Gilliland

It is certified that error appears in the above-identified patent and that said Letters Patent is hereby corrected as shown below:

Column 3, line 40, at the end of the paragraph, the following sentence should appear:

--- In the modification of Fig. 8, a pair of additional like ears 34, 34 are provided adjacent ears 32 to frictionally hold the hook member in a rearwardly extended position. ---

Column 3, line 43, cancel numeral "34" and insert therefor the reference character --- C ---.

In Figs. 5 and 6, the reference numeral "36" in the application as filed has been corrected in the patent drawings to --- 38 --- to conform to the specification.

Signed and Sealed this

Twenty-second Day of December, 1998

Bruce Lehman

*Attest:*

BRUCE LEHMAN

*Attesting Officer*

*Commissioner of Patents and Trademarks*